US007314004B2

(12) United States Patent
Biggs et al.

(10) Patent No.: US 7,314,004 B2
(45) Date of Patent: Jan. 1, 2008

(54) METHOD FOR DELAYED DETONATION OF A PENETRATING WEAPON AND RELATED APPARATUS AND SYSTEMS

(75) Inventors: Bradley M. Biggs, Plymouth, MN (US); William A. Friedrich, Minnetonka, MN (US)

(73) Assignee: Alliant Techsystems Inc., Edina, MN (US)

( * ) Notice: Subject to any disclaimer, the term of this patent is extended or adjusted under 35 U.S.C. 154(b) by 8 days.

(21) Appl. No.: 11/148,955

(22) Filed: Jun. 9, 2005

(65) Prior Publication Data

US 2006/0090663 A1 May 4, 2006

Related U.S. Application Data

(60) Provisional application No. 60/578,163, filed on Jun. 9, 2004.

(51) Int. Cl.
*F42C 9/00* (2006.01)
*F42C 1/00* (2006.01)

(52) U.S. Cl. ..... 102/215; 102/206; 102/266

(58) Field of Classification Search ..... 102/215
See application file for complete search history.

(56) References Cited

U.S. PATENT DOCUMENTS 2,465,395 A * 3/1949 O'Rear ..... 102/242
3,738,275 A 6/1973 Schwartz et al.
3,851,522 A * 12/1974 Peterson ..... 73/84
4,375,192 A 3/1983 Yates et al.
4,541,341 A * 9/1985 Fowler et al. ..... 102/215
4,586,436 A * 5/1986 Denney et al. ..... 102/206
4,799,427 A * 1/1989 Held et al. ..... 102/215
5,122,731 A 6/1992 Cole (Continued)

FOREIGN PATENT DOCUMENTS

WO WO 03/051794 A2 6/2003

OTHER PUBLICATIONS

Maxim Integrated Products, Filter Basics: Anti-Aliasing, Jan 11, 2002, internet document, http://pdfserv.maxim-ic.com/en/an/AN928.pdf, entire document.*

(Continued)

*Primary Examiner*—Bret Hayes
(74) *Attorney, Agent, or Firm*—TraskBritt

(57) ABSTRACT

The present invention is directed to a system and a method for accurately locating a penetrating-type weapon within a shelter for detonation at a desired target site. The method includes detecting a deceleration threshold event indicative of the penetrating weapon impacting and traversing a layer of shelter having certain material or structural characteristics (e.g., a "hard" or a "thick" layer). A delayed detonation program or process is enabled upon detection of the threshold event. For example, a delayed detonation program or process may include layer counting, void counting, or a combination of layer and void counting until the desired number of layers (and/or voids) of a shelter has been detected, at which time the weapon may be detonated. Any deceleration events that occur prior to the deceleration threshold event are ignored to minimize the potential failure of detecting specific types of layers including certain types of "soft" or "thin" layers.

37 Claims, 4 Drawing Sheets

U.S. PATENT DOCUMENTS 5,180,882 A * 1/1993 Bansard ..... 102/216
5,255,608 A 10/1993 Min et al.
5,872,324 A * 2/1999 Watson et al. ..... 102/265
6,053,109 A * 4/2000 Rudenauer ..... 102/266
6,105,505 A 8/2000 Jones
6,129,022 A * 10/2000 Hickey et al. ..... 102/221
6,276,277 B1 8/2001 Schmacker
6,378,435 B1 * 4/2002 Bai et al. ..... 102/215
6,469,639 B2 10/2002 Tanenhaus et al.
6,483,323 B1 11/2002 Bai et al.
7,124,689 B2 * 10/2006 Davis et al. ..... 102/216
2003/0140811 A1 * 7/2003 Bone ..... 102/266

OTHER PUBLICATIONS

GlobalSecurity.org, Guided Bomb Unit 24 (GBU-24) Paveway III, http://www.globalsecurity.org/military/systems/munitions/gbu-24.htm, visited May 17, 2005, 6 pages.

Picatinny, Fuzes, http://www.pica.army.mil/PicatinnyPublic/products_services/products19.asp, visted May 17, 2005, 4 pages.

* cited by examiner

METHOD FOR DELAYED DETONATION OF A PENETRATING WEAPON AND RELATED APPARATUS AND SYSTEMS

CROSS-REFERENCE TO RELATED APPLICATION

The present application claims the benefit of U.S. Provisional Application Ser. No. 60/578,163 entitled METHOD FOR MEDIA COUNTING USING MINIMUM MEDIA THICKNESS ENABLING filed on Jun. 9, 2004, the disclosure of which is incorporated by reference herein in its entirety.

BACKGROUND OF THE INVENTION

1. Field of the Invention

The present invention generally relates to weapons and artillery and, more particularly, to penetrating systems and penetrating weapons that may be used, for example, to damage and destroy sheltered targets.

2. State of the Art

In military operations, targets may be generally classified as either unsheltered targets or sheltered targets. Unsheltered targets may be considered to include targets which are substantially exposed and vulnerable to a weapon or projectile fired by artillery directed at such targets. For example, people, munitions, buildings and other fighting equipment that are openly located on a battle field and substantially exposed to the weapons of an enemy attack may be considered unsheltered targets.

However, many targets including, for example, people, munitions, chemicals, and fighting equipment may be sheltered in order to protect them from an attack by various weapons. Conventionally, a shelter for a target includes a physical barrier placed between the target and the location of origin of an expected enemy weapon in an attempt to frustrate the weapon directed at the target and mitigate the damage that might otherwise be inflicted by such a weapon. In some cases targets may be heavily sheltered in an attempt to prevent any damage to a given target. In one example, one or more layers of concrete, rock, soil, or other solid material may be used in an effort to protect a desired target. Each layer may be several feet thick, depending on the level of protection desired. Sometimes these layers are referred to as "hard" layers indicating a relative amount of resistance that they will impose on an impending weapon. Generally, a layer is considered to be "hard" when it exhibits a specified level of thickness, when it is formed of a material exhibiting a specified level of hardness or some other material characteristic which significantly impedes penetration of a weapon, or when the layer exhibits a desired combination of material properties and physical thickness.

More specific examples of shelters for targets include a building, a room in a building, a bunker, a room in a bunker, or a room or a bunker located beneath a building. Considering a bunker as an example, the ceiling of a bunker may be configured as a hard layer in order to protect people, things, or a combination thereof, from non-penetrating weapons. Additionally, multiple hard layers may be used to shelter a target. Voids may be present between multiple layers for structural reasons or for purposes of trying to confuse existing weaponry designed to defeat such shelters by causing premature detonation.

In order to penetrate shelters, and particularly a hard layer (or layers) of a given shelter, a weapon configured with a penetrator system is conventionally used. The general goal of using a penetrator system is to breach the shelter, including any thick layers that may be present, and deliver the weapon to a desired location (i.e., proximate the intended target) while delaying detonation of the weapon until it is at the desired location. Thus, use of a penetrator system enables a more efficient and a more effective infliction of damage to a sheltered target and, sometimes, use of such a system is the only way of inflicting damage to certain sheltered targets.

A penetrator system is part of a weapon system which may include one or more warheads, a penetrator structure (generally referred to as a penetrator) and a sensor associated with and coupled to the penetrator. The penetrator may be configured to act as a warhead, or it may be a separate component, but generally includes a mass of relatively dense material. In general, the capability of a penetrator to penetrate a given layer of media is proportional to its sectional density, meaning its weight divided by its cross-sectional area taken along a plane substantially transverse to its intended direction of travel. The weapon system may include equipment for guiding the weapon to a target or, at least to the shelter, since, in many cases, forces associated with impact and penetration of a shelter may result in the removal of such equipment from the penetrator portion of the weapon. The sensor of a penetrator system is conventionally configured to assist in tracking the location of the penetrator as it penetrates layers of one media type or another after an initial impact of the penetrator with the shelter.

Some prior art penetrator system sensors are configured to detect an initial impact with a structure and then measure the amount of time that has lapsed subsequent the detected impact in an effort to keep track of the location of a penetrator, based on calculated or estimated velocity of the weapon, as the penetrator penetrates a shelter. These sensors are generally referred to as time-delay sensors.

Other prior art penetrator system sensors use an accelerometer to measure the deceleration of the penetrator, from the time it makes an initial impact with a layer of a shelter or structure, in an effort to track the distance that a penetrator travels after impact with an initial layer. These sensors have generally been referred to as penetration depth sensors.

Some prior art penetrator systems utilize an accelerometer to detect deceleration of relatively hard and/or thick layers in an effort to help count the layers of media, count voids between the layers of media, or count both media layers and voids.

Such prior art time-delay and penetration depth sensors, in association with other system components, provide an output signal for detonating the weapon after the penetrator system has determined that the penetrator has arrived at a desired location within the shelter based on either time of travel information, depth of penetration information, or media counting information. When the penetrator system is programmed with a time delay or penetration depth parameter, the penetrator system detonates the weapon when the programmed parameter matches the actual penetration time or penetration distance of the weapon after an impact with an initial layer. Desirably the detonation of the weapon occurs at a target site such as within a specified room of a bunker. However, in practice, any of a number of factors, such as variability in the physical or material characteristics of a given layer or the presence of other, unexpected physical components associated with a shelter, can alter the actual time required to travel from the initial point of impact with a shelter to the desired target or the perceived distance traveled by a penetrating weapon after initial impact with a layer of a shelter.

Variations in a shelter, or in a layer of a shelter, may include variations in the thickness and/or hardness of a building's (or bunker's) roof and floors, variations in the number and types of mechanical equipment within a shelter (e.g., plumbing and HVAC equipment within a building), variations in the furnishings within the shelter, or the existence of other structural features of the shelter not previously considered or anticipated. With respect to the thickness and hardness of a given shelter layer, such may not always be known due to many variables including, for example, type of media the layer is formed of (e.g., concrete, soil, or sand), thickness of each media in the layer, the age of a layer (e.g., the age of a concrete layer), soil type, moisture content of a given layer, and temperature of a layer or its surrounding environment. It is noted that, for example, frozen or compacted soil is much harder than sand and, therefore, provides a different level of resistance to penetration.

Due to the existence of such variations in a shelter, and the inability of prior art penetrator systems to account therefor, such penetrator systems may cause the weapon to prematurely detonate or to detonate late such that it does not detonate at the actual site of the intended target. More specifically, prior art systems using time-delay or penetration depth sensors can be used to accurately detonate the penetrator at a specified location (e.g., a specified room in a bunker) only if the thickness and hardness of each media from the roof to the room are known. Since the thickness and hardness of the media are conventionally not known for many constructions over a bunker, prior art time delay and penetration depth sensors cannot reliably fire a penetrator at the desired location.

Additionally, while penetrator systems have been used to detect decelerations that result from the presence of a relatively thick or hard layer, such penetrator systems cannot effectively detect layers that are thin, soft, or some combination thereof, due to the relatively low amount of deceleration experienced by the penetrating weapon when passing through such thin or soft layers. Some examples of "thin" layers include ceilings and floors in buildings that may be located over a target. Some examples of "soft" layers include layers of sand or other soft soil. Generally, a layer is too thin or too soft to detect when the deceleration of a penetrating weapon, as it passes through such a layer, cannot be discerned from electrical noise, mechanical noise, or combination of electrical and mechanical noise experienced by the sensor. For example, a penetrator system may experience mechanical noise through the vibrations induced into the penetrator system upon impact and penetration of a given layer.

Some prior art systems have utilized gain switching in an effort to detect relatively thin layers. Gain switching generally includes use of a high gain amplifier to detect low levels of deceleration by the penetrating weapon and use of a lower gain amplifier as deceleration of the penetrating weapon increases. Such gain switching may occur between a computer sampling of the penetrating weapon's deceleration. Gain switching may generally be accomplished using one or more amplifiers, one or more analog-to-digital converters, or some combination thereof.

As briefly noted above, some prior art penetrator systems have employed what may be referred to as void and layer counting methods. Generally, such penetrator systems utilize sensors in an effort to count discrete layers, voids or both, after detecting an initial impact. However, these penetrator systems cannot reliably detonate a penetrator at the intended target location since, as with other systems, they cannot reliably detect and count the thin layers of a given shelter building. If a layer is not properly detected, the penetrator system will detonate the penetrator late, at a location beyond that of the intended target. Some attempts have been made to adjust the sensor thresholds of a penetrator system so that they only detect so-called "hard" layers and effectively ignore all thin or soft layers of a shelter. However, such attempts unfortunately result in the sensor ignoring a layer that is significant to a well-timed detonation such as, for example, the ceiling of a bunker, again resulting in the detonation of the penetrating weapon at an undesired location.

Other configurations of prior art systems have included redundancy such that multiple samples of deceleration are required to verify detection of a layer and prevent early detonation of the weapon. Such redundancy systems have also been used in conjunction with time-delay and penetration depth systems.

In yet other prior art penetrator systems, attempts have been made to prevent the system from counting a single layer as more than one layer. To do so, such penetrator systems used a programmed distance, sometimes referred to as a "blanking distance," to ignore both false layers and real layers after the penetrator system detected deceleration. In one example, a prior art penetrator system would calculate and measure the blanking distance traveled by the penetrator system based on the penetration velocity of the penetrator system at the time of its impact with a layer and the time that expired after such impact. Some other penetrator systems have also used the deceleration values and the detection of an exit of the penetrator system from a penetrated layer to help determine the blanking distance.

There is a continued desire to improve the penetrator systems used in weapons so as to increase their accuracy in determining their arrival at a desired location and thereby ensure a maximization of damage inflicted on a desired target. It would be desirable to provide such improvements through simple implementations so, for example, existing prior art systems may be updated and retrofitted in a simple and inexpensive manner.

BRIEF SUMMARY OF THE INVENTION

The present invention is directed to a system and a method for accurately locating a penetrating-type weapon within a shelter for detonation at a desired target site. The method includes detecting a deceleration threshold event indicative of the penetrating weapon impacting and traversing a layer of shelter having certain material or structural characteristics (e.g., a "hard" or a "thick" layer). A delayed detonation program or process is enabled upon detection of the threshold event. For example, a delayed detonation program or process may include layer counting, void counting, or a combination of layer and void counting.

In accordance with one aspect of the invention, a method of locating a penetrating-type weapon within a shelter is provided. The method includes projecting the weapon through at least one layer of shelter and detecting a minimum specified deceleration threshold. A delayed detonation program is enabled and executed in response to detecting the minimum specified deceleration threshold. The weapon is then delayed in accordance with the delayed detonation program. The minimum specified deceleration threshold may include a specified minimum magnitude of the deceleration rate, a specified minimum duration of the detected deceleration, or some combination thereof.

In accordance with another aspect of the invention, a method of operating a weapon is provided. The method includes launching the weapon at a sheltered target and penetrating at least a first layer of the sheltered target with the weapon and detecting a deceleration of the weapon associated therewith. A determination is made regarding whether the deceleration associated with the penetration of the at least a first layer meets a specified threshold. The deceleration associated with the penetration of the at least a first layer is ignored if it does not meet the specified threshold. However, a delayed detonation program of the weapon is enabled if the deceleration associated with the penetration of the at least a first layer meets the specified threshold. An additional layer of the sheltered target is penetrated by the weapon system subsequent an enablement of the delayed detonation program and deceleration imposed by the additional layer of the sheltered target is chronicled regardless of whether it meets the specified threshold.

In accordance with yet another aspect of the invention, a weapon system is provided. The weapon system includes an explosive device having a penetrator structure. At least one sensor is configured to detect deceleration of the weapon system upon impact with a media layer and to produce a signal representative of a deceleration of at least a portion of the weapon system. A computer is in electrical communication with the at least one sensor and configured to ignore detection of all deceleration events by the at least one sensor prior to detection of a minimum specified deceleration threshold. The system may further include additional components such as filters, analog-to-digital converters, power conditioning and grounding equipment, and detonating mechanisms configured to detonate the explosive device upon receipt of a signal from the computer.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
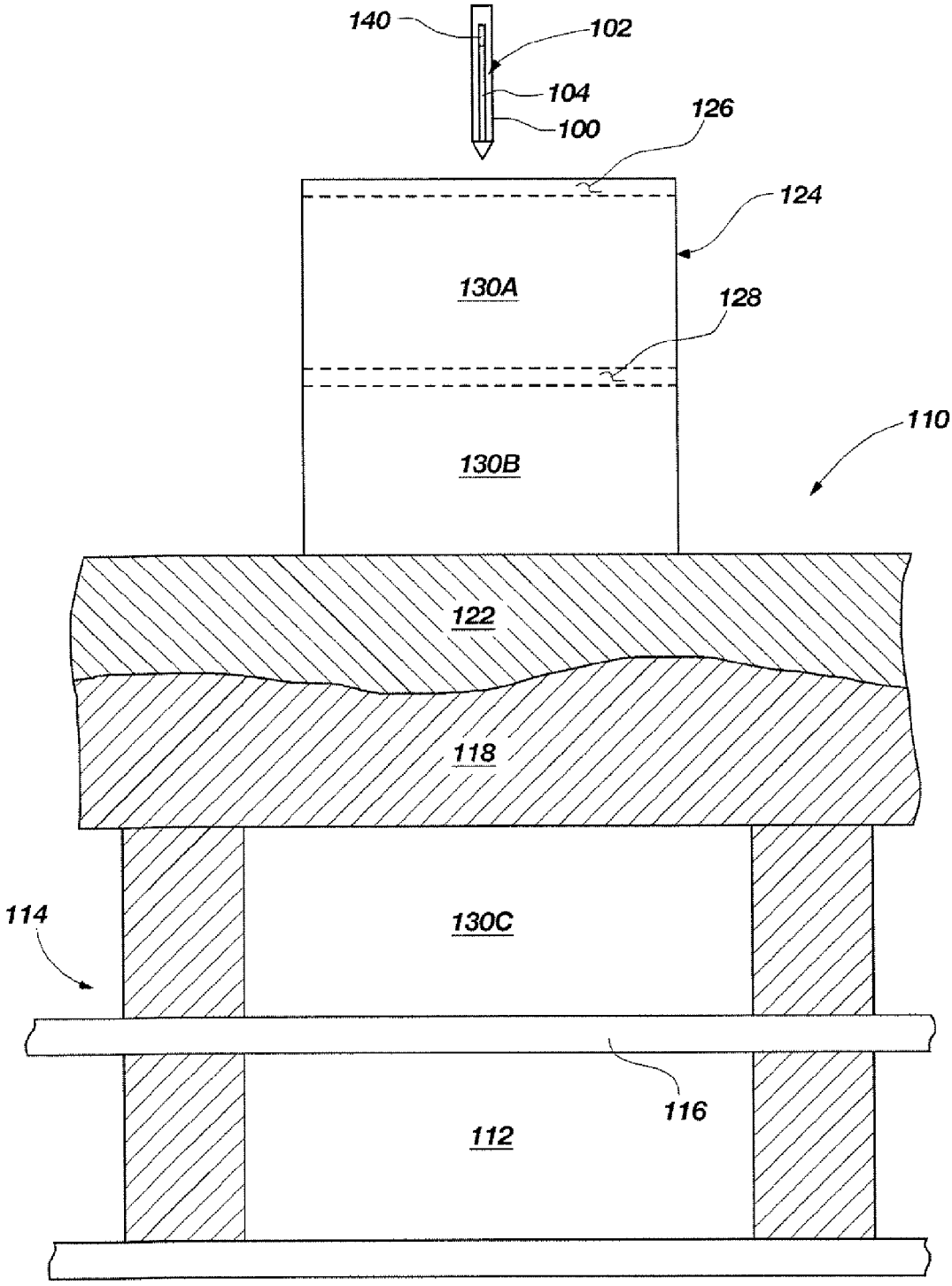
FIG. 1 is a schematic of a weapon having a penetrator system directed at a sheltered target in accordance with one embodiment of the invention.

Referring to FIG. 1, a weapon 100 is shown which includes a penetrator system 102. The penetrator system 102 may include a structural penetration component, referred to herein as a penetrator 104. The penetrator 104 may include a mass of relatively dense material. In general, the capability of a penetrator 104 to penetrate a given layer of media is proportional to its sectional density, meaning its weight divided by its cross-sectional area taken along a plane substantially transverse to its intended direction of travel. The penetrator system 102 also includes various electrical components, mechanical components, or both for detection of the layers of a shelter, for enablement of a delayed detonation program and the ultimate detonation of the weapon 100 as will be discussed in more detail hereinbelow.

While not explicitly shown in FIG. 1, the weapon 100 or the penetrator 104 may include a booster. Thus, upon impact with a layer, the weapon 100 or the penetrator 104 may include a propulsion system to drive the weapon 100 or penetrator 104 through, and sometimes beyond, the layer that it has impacted.

The weapon 100 is shown in FIG. 1 to be descending on a sheltered target 110. Generally, the sheltered target may include one or more layers or barriers. Such layers may be formed, for example, of sand, soil, limestone, granite, rock, concrete, or other media including a variety of man made structures. In one, more particular example, the intended target to be destroyed or damaged by the weapon 100 may include a targeted room 112 inside a bunker 114. As discussed hereinabove, bunkers may be disposed below a layer of soil, a layer of hard or thick material, below a building or other structure, or some combination thereof. In the example shown in FIG. 1, the bunker 114 is shown to be located sequentially below a first layer, (referred to herein as the proximate layer 116 for convenience due to its proximity to the targeted room 112) such as the floor or ceiling or other structure within the bunker 114, a thick and hard layer of material such as reinforced concrete (referred to herein as a hard layer 118 for purposes of convenience), a layer of earth or soil 122, and a building 124. Additionally, the building 124 includes a roof 126 and at least one floor 128 (or ceiling) formed therein. Thus, in the example shown in FIG. 1, the weapon 100 must traverse several layers (i.e., the roof 126, the floor 128, the layer of soil 122, the hard layer 118 and the proximate layer 116) before arriving at the desired room 112 inside the bunker 114. It is noted that the proximate layer 116 may exhibit any of a various number of configurations (e.g., another hard layer, a thick layer, a soft layer, a thin layer, etc.).

The sheltered target 110 also includes voids such as areas or volumes between discrete layers. Thus, for example, one void 130A exists between the roof 126 and floor 128 of the building 124, another void 130B between the floor 128 and the soil 122, and yet another void 130C exists between the hard layer 118 and the proximate layer 116. Additionally, the targeted room 112 inside the bunker 114 may be configured as a void.

It is noted that the sheltered target 110 shown in FIG. 1 is merely an example and not limiting to the types and configurations of targets against which the present invention may be used. Those of ordinary skill in the art will appreciate that the sheltered target 110 may include additional layers, whether thick, thin, hard or soft, and additional voids. Similarly, the "hard" layer 118 could simply be a thick layer (of relatively softer material than that described hereinabove), or it could be a soft or thin layer depending, for example, on the configuration of the other layers of the sheltered target 110.

In a prior art penetrator system, any of the sheltered target layers, and particularly, the soft or thin layers such as the roof 126, the floor 128 or a layer of soil 122 (assuming such soil to be "soft") could be "missed" by the sensor of the penetrator system 102 or otherwise misread by the system resulting in the weapon 100 detonating at an undesired location relative to the bunker 114. However, the present penetrator system 102 is configured to effectively ignore various thin or soft layers until a desired deceleration event occurs or, in other words, until a specified deceleration threshold is met. Such an event may be in association with the weapon 100 and penetrator 104 encountering a hard layer, a thick layer, or a combined thick and hard layer, which is sufficient to decelerate the penetrator system by a desired magnitude, for a desired amount of time or some defined combination thereof.

Figure 2:
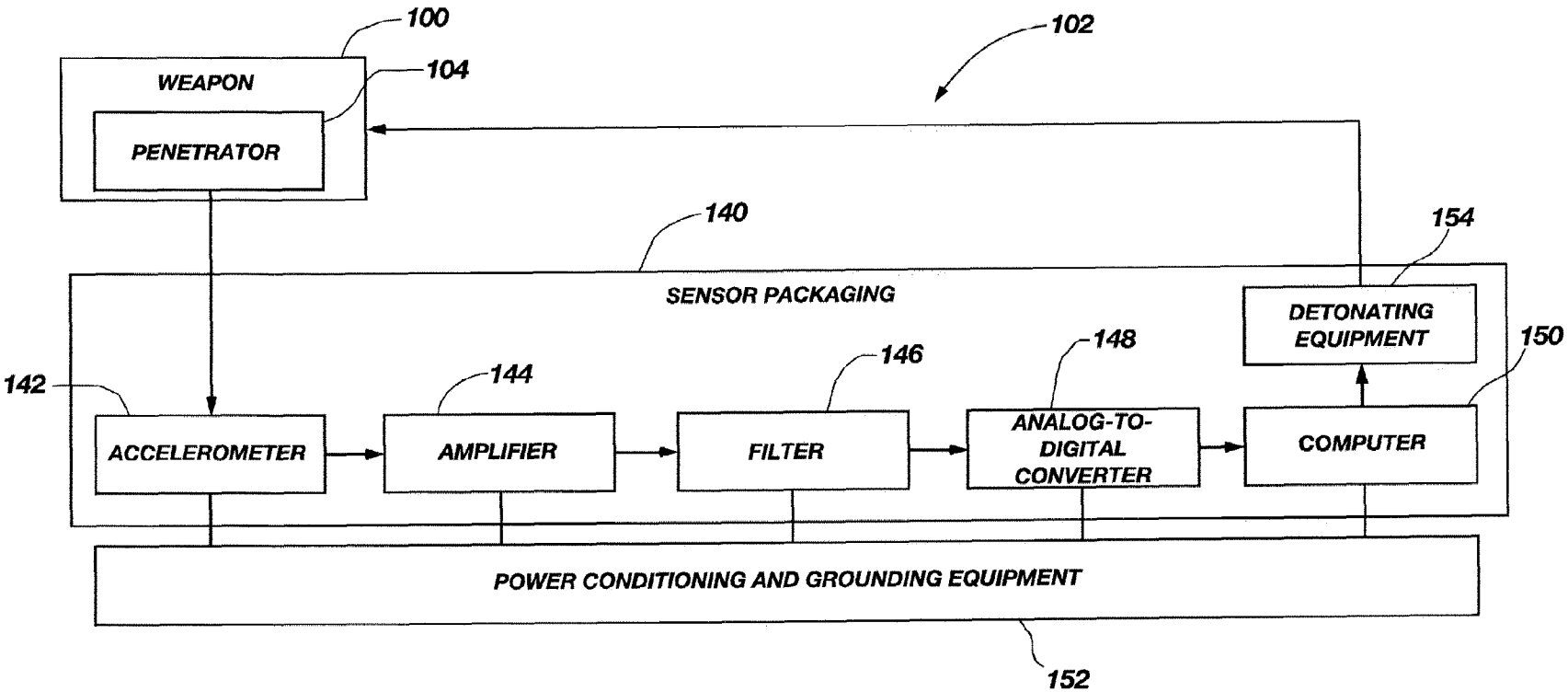
FIG. 2 is a block diagram of a penetrator system in accordance with an embodiment of the present invention.

Referring briefly to FIG. 2 in conjunction with FIG. 1, a block diagram is shown of a penetrator system 102 in accordance with one embodiment of the present invention. The penetrator system 102 is configured to detect a deceleration event prior to enabling the system for subsequent actions.

The penetrator system 102 includes sensor packaging 140 that is coupled with the penetrator 104. The sensor packaging 140 may include structure for securing it to the penetrator 104 or some other portion of the weapon 100. For example the sensor packaging 140 may include threaded structure for coupling with mating threads formed on or in the penetrator 104. Such a threaded configuration may also include a threaded lock ring and a locking plate as will be appreciated by those of ordinary skill in the art. In other embodiments, the sensor packaging 140 may be welded, bonded or otherwise fastened or joined with the penetrator 104 or weapon 100.

The sensor packaging 140 may further include, for example, at least one sensor such as an accelerometer 142, as well as an amplifier 144, a fiher 146, an analog-to-digital (A/D) converter 148, a computer or computer processor 150, power conditioning and grounding equipment 152, and detonating equipment 154. in the presently considered embodiment, the accelerometer 142 is configured to measure the deceleration of the penetrator 104 imposed by the sheltered target 110 (or a layer thereofl and provides an analog signal, representative of the penetrator deceleration, to the amplifier 144. The amplifier 144 amplifies the signal received from the accelerometer 142 and provides the amplified signal to the filter 146. The filter 146 is electrically connected to the A/D converter 148 and prevents aliasing of the amplified analog signal when the AID convener 148 converts the analog signal (representing the penetrator deceleration) to a digital signal. Additional filters may also be used to filter out any electrical noise, mechanical noise, or combinations thereof from the signal generated by the accelerometer 142.

The A/D converter 148 is connected to the computer 150 for examining the digital signal that represents the detected penetrator deceleration in light of any data or other parameters programmed or stored in the computer 150. The computer 150 may include, for example, a digital signal processor, a field programmable gate array, a microcontroller such as is available, for example, from Motorola®, a PIC® type semiconductor available from Microchip Technology Inc., or other appropriately configured circuits.

The computer 150 is connected to the detonating equipment 154 which is explosively connected to the weapon 100 for detonating the weapon 100 upon receipt of an appropriate signal from the computer 150. The detonating equipment 154 may include, for example, a squib, a semiconductor bridge, or other mechanisms or components configured to ignite the explosive, incendiary or pyrotechnic material contained by the weapon 100.

It is noted that the configuration shown in FIG. 2 is merely an example of one possible embodiment of the present invention and that various other configurations and arrangements may be used. For example, in one embodiment the filter 146 may be integrated into the amplifier 144. In another embodiment, the filter 146 may be placed before the amplifier 144 such that it processes the signal produced by the accelerometer 142 prior to the amplifier 144 receiving such a signal. In some embodiments, the filter 146, the computer 150, or a combination of the two components may include filtering for distinguishing deceleration experienced by the weapon 100, deceleration experienced by the penetrator 104 relative to that of the weapon 100, acceleration by either or both components, or any combination of such parameters.

Additionally, the accelerometer 142 may include, for example, a capacitive accelerometer, a resistive accelerometer, a micro electromechanical (MEM) accelerometer, or any combination of such accelerometers. Other sensors may also be used. Similarly, various types, or combinations, of filters, amplifiers, and A/D converters may be used. In one embodiment, the penetrator system may be configured with all analog components. In another embodiment, the penetrator may be configured to utilize gain switching.

Using a penetrator system 102 such as shown and described with respect to FIG. 2, the penetrator system 102 may be programmed to detonate the weapon 100 via the detonating equipment 154 upon the occurrence of a desired sequence of events. The computer 150 may, therefore, be programmed with appropriate software such as C++ or any other appropriate language including, for example, machine language, assembly language, a higher programming language or some combination thereof Referring now to FIG. 3 in conjunction with FIGS. 1 and 2, a method of operating the weapon 100 and its associated penetrator system 102 is shown. As indicated at 160, the weapon is launched. The weapon 100 may be launched from a stationary launch pad or from a mobile vehicle such as a naval ship or an aerospace vehicle. In some embodiments, the weapon may be disabled from detonating until the weapon has traveled a desired distance so as to prevent an errant weapon from detonating within the first few moments after launch. After launch, the penetrator system 102 waits to detect a deceleration of the penetrator 104, the weapon 100, or both, as indicated at 162. If a deceleration is detected, a signal is produced (such as by accelerometer 142) representative of the deceleration and the computer 150 analyzes the deceleration signal to determine whether it meets a threshold level as indicated at 164. The deceleration threshold may be based on the magnitude of the detected deceleration (e.g., the amount of deceleration anticipated upon impact with a hard layer), a minimum amount of time of sustained deceleration (e.g., the sustained deceleration of the weapon 100 or penetrator 104 imposed by a thick layer), or some predefined combination of both parameters. If the deceleration threshold is not met, the process returns to the act of detecting additional deceleration events as indicated by loop 166. However, if the deceleration threshold is met, then a delayed detonation program of the penetrator system 102 is enabled as indicated at 168.

Once a delayed detonation program is enabled, the penetrator system 102 waits for at least one additional event to occur as indicated at 170. In one embodiment, the additional event or events include the counting of media layers, voids, or both layers and voids, to determine the desired detonating location of the weapon. In another embodiment, such counting of layers, voids or both may not occur until after a specified blanking distance such as has been previously described. In a related embodiment, the invention may employ a blanking distance and, then after detecting another deceleration event (which could include any deceleration event or it could include another threshold deceleration event) employ one or more additional blanking distances.

In yet another embodiment, the additional event may include the determination of descending a desired depth or traveling for an additional amount of time such as with more conventional depth-detection or time-delay systems that have been described hereinabove. If the specified event or events have not occurred, the penetrator system 102 continues to look for such events as indicated by loop 172. If, however, the specified event or events have been detected by the penetrator system 102, the computer 150 of the penetrator system 102 provides a signal to the detonating equipment 154 to detonate the weapon 100 as indicated at 174.

Thus, for example, with specific reference to FIG. 1, the weapon 100 may descend through multiple layers (e.g., the roof 126, the floor 128, the layer of soil 122) and multiple voids (e.g., 130A and 130B) without the deceleration threshold being met. In other words, while such layers impose a certain amount of deceleration on the weapon 100 and its penetrator 104, such deceleration may be of relatively short duration (e.g., as imposed by the thin layers of the roof 126 and floor 128) or may be of relatively low magnitude (e.g., such as might be imposed by the layer of soil 122 assuming that the soil was a soft layer) so as to not meet the criteria of the desired deceleration threshold. Thus, the weapon 100 with its penetrator system 102 continues toward the targeted room 112 of the bunker 114, effectively ignoring the layers (126, 128 and 122) and voids (130A and 130B) it encounters and traverses until the deceleration threshold is detected.

For example, the hard layer 118 may impose a sufficiently high magnitude of deceleration, a sufficiently long period of deceleration, or a combination of both parameters so as to enable the delayed detonation program or process of the penetrator system 102. Considering the delayed detonation program of the penetrator system 102 to include a layer/void counting process, the penetrator system then begins counting layers, voids, or both. Referring to the sheltered target 110 shown in FIG. 1, the penetrator system 102 may be configured, for example, to count one void (i.e., 130C) and one layer (e.g., 116) before detonating the weapon 100 via the detonating equipment 154. In other embodiments, the penetrator system 102 may be configured to count only layers (including any desired combination of thick, thin, soft and hard layers), count only voids, to delay detonation for a desired amount of time, or to delay detonation until a desired depth had been reached by the weapon 100.

It is again emphasized that the sheltered target 110 shown and described with respect to FIG. 1 is merely an example for aid in illustration of one embodiment of the present invention and that various types of structures exist for which the present invention finds applicability. Thus, any number of layers, voids, or both may exist within a structure subsequent (in terms of penetrator travel) a hard or thick layer which is sufficient to meet the deceleration threshold requirements of the penetrator system 102. Also, such additional layers may include any combination of thick, thin, hard and soft layers.

Figure 3:
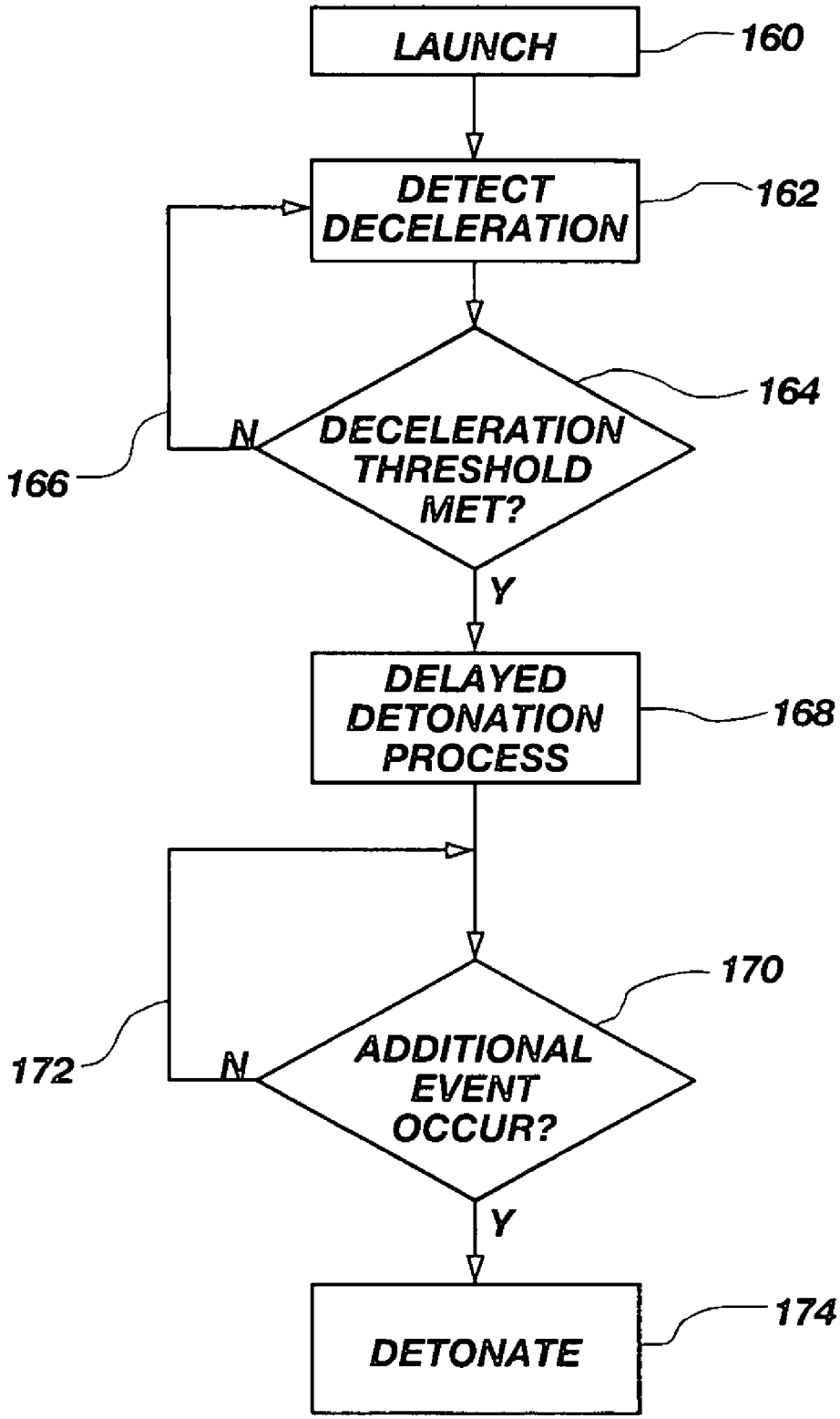
FIG. 3 is a flow chart showing the operation of a penetrator system in accordance with an embodiment of the present invention.

Still considering the method of operating the weapon 100 that is described with respect to FIG. 3, specific implementations of the described method may vary. In one embodiment, the detection of a deceleration threshold event may include detecting a minimum layer thickness. This may be accomplished in a variety of ways. For example, detecting a minimum layer thickness may be accomplished by detecting and measuring a deceleration of the weapon 100 or penetrator 104 that is above a specified minimum deceleration level and which continues for a minimum duration of time. It is noted that the specified minimum deceleration level may be a "floating" threshold in that it may be dependent on the velocity of the weapon 100. Thus, as the velocity of the weapon decreases, the penetrator system 102 may adjust the specified minimum deceleration level to compensate for the change in velocity.

In another embodiment, detection of the minimum layer thickness may include detecting a minimum velocity change in the weapon 100 or penetrator 104. Yet another way of detecting a minimum layer thickness may include measuring the distance that the weapon 100 and penetrator 104 have traveled while experiencing a minimum specified level of deceleration. The distance traveled may be calculated by providing the penetrator system 102, including the computer 150, with certain data and parameters, measuring other data with a sensor such as the accelerometer 142, and computing the distance traveled by the weapon 100 and penetrator 104 as will be appreciated by those of ordinary skill in the art.

For example, the computer 150 may be programmed or otherwise provided with mission data and a combination of parameters related to the intended target including, for example, one or more of: the magnitude of the specified minimum layer thickness that is to be detected by the system; the magnitude of the specified minimum velocity change; an anticipated impact velocity (or velocity of the weapon when it impacts the layer); a specified minimum deceleration level that should be detected to verify the presence of a layer; or a minimum time for which the specified minimum deceleration should be sustained. The combination of actual parameters and data provided to the computer 150 may depend, at least in part, on the method used to detect the minimum thickness layer. Additionally, the computer 150 may be programmed with information regarding the delayed detonation program (e.g., data related to media counting or void counting).

Having such data and parameters programmed into the penetrator system 102, the penetrator system 102 may operate by first detecting impact though deceleration measurements. The velocity of the weapon 100 and penetrator 104 may be continually updated utilizing such deceleration measurements, such updating including deceleration measurements from multiple impacts and deceleration measurements in some embodiments. If the specified minimum layer thickness is detected, such as by measuring a deceleration equal to, or greater than, the specified minimum deceleration for a period of time equal to, or greater than, the specified minimum time, then the delayed detonation program is enabled. If the delayed detonation program includes media or void counting, the penetrator system 102 continues to detect and measure the deceleration of the weapon 100 and penetrator 104 to verify the number of layers or voids through which the weapon 100 has subsequently passed. Upon meeting the criteria of the delayed detonation program, the weapon 100 is detonated.

It is noted that the penetrator system 102 may be provided or programmed with the desired data and parameters during manufacture of the weapon 100 and penetrator system 102, at a time prior to launch, or even after launch and during delivery of the weapon 100 to its intended target. Such data may be provided to the penetrator system 102 through a wired connection or by wireless transmission.

Figure 4:
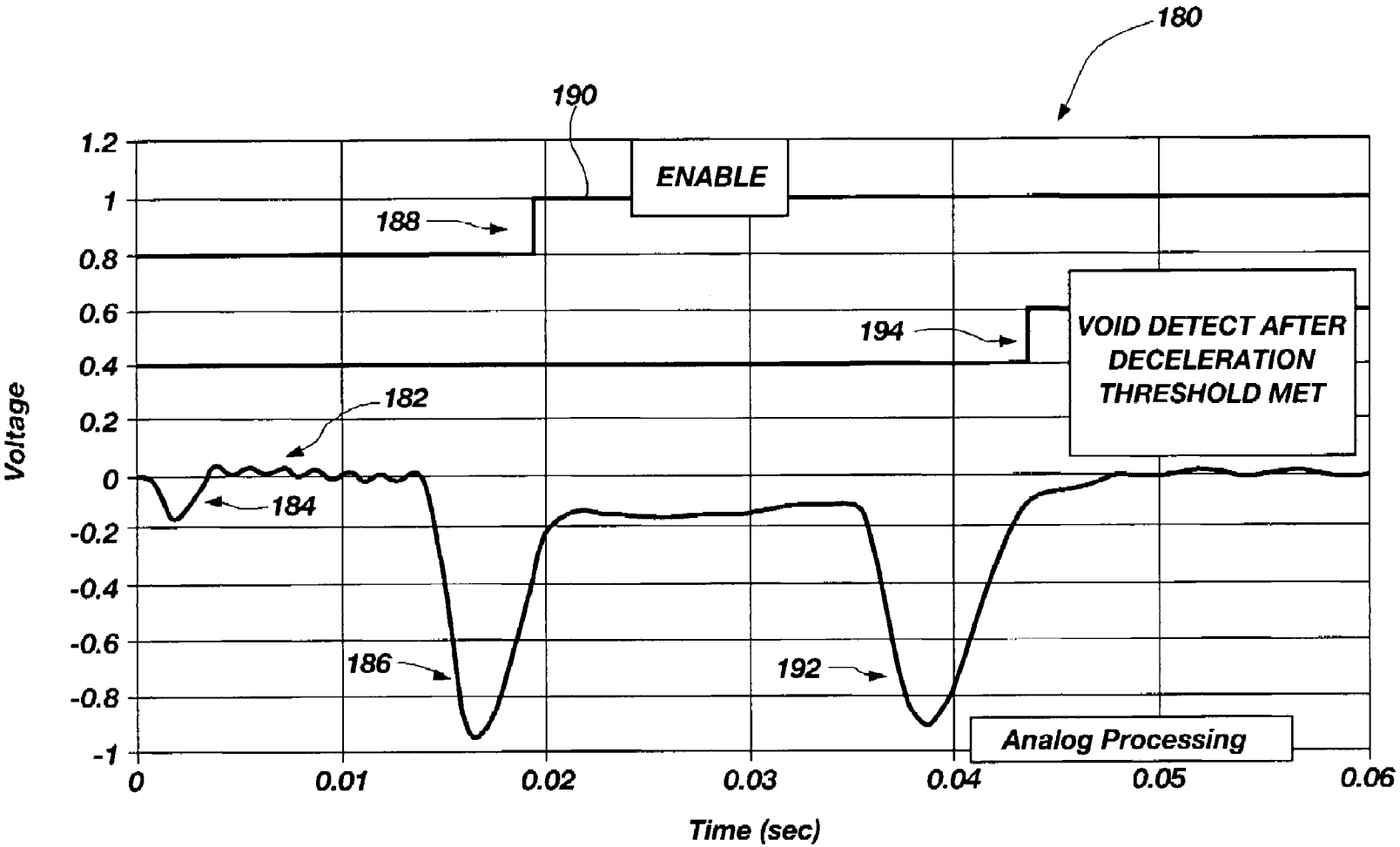
FIG. 4 is a graphical representation of the electrical output signals of a penetrator system in accordance with an embodiment of the present invention.

Referring now to FIG. 4 in conjunction with FIGS. 1 through 3, a graph 180 shows a representation of the signals (or states, depending on the actual configuration of the system) that are generated by the penetrator system 102 in one example of operation. Referring first to the plot indicated at 182, a representation is shown of the analog signal produced by an accelerometer 142 when a weapon 100 is impacting a sheltered target 110. As shown at 184, the accelerometer detects minor deceleration of the weapon 100 or penetrator 104 at an early stage of the graph (as indicated by the drop in voltage). Such a relatively small deceleration may, for example, be the result of encountering a thin or a soft layer (e.g., such as the roof 126 or floor 128 of the building 124 shown in FIG. 1). Because this level of deceleration does not meet or exceed the desired threshold of deceleration (e.g., because either its magnitude is too small, its duration is too short, or some combination thereof), the penetrator system 102 takes no action and effectively ignores the deceleration detected at the indicated plot location 184.

Subsequently, a relatively large deceleration is detected by the accelerometer 142 as indicated at 186. Such deceleration may, for example, be the result of a hard or a thick layer (e.g., the hard layer 118 of the bunker 114 shown in FIG. 1). Such a deceleration, in this example, meets or exceeds the deceleration threshold, either in magnitude, duration or some defined combination thereof. As a result, the penetrator system may produce an ENABLE signal (or an ENABLE state within the computer 150 or an associate memory component), as indicated at 188, to enable a delayed detonation program (such as a layer or media counting program or process) as may be seen by the change in voltage from 0.8 volts to 1.0 volts in the enable signal 190. Thus, the process indicated at 170 and described with respect to FIG. 3 is initiated by the penetrator system 102.

Still referring to the graph 180 in FIG. 4, subsequent the detection of a layer that imposes a deceleration on the weapon 100 and penetrator 104 equal to or greater than a defined threshold, another deceleration is detected by the penetrator system as indicated at 192. As may be discerned from the accelerometer plot 182, this deceleration may be due to another substantially hard or thick layer. However, it is noted that, once the ENABLE signal or state is promulgated, detection of additional layers is not limited to those which are hard or thick. Rather, any layer may be detected including those which would not meet the deceleration threshold requirements prior to the ENABLE signal or state or state being produced. In other words, should the deceleration that was detected at plot location 184 have occurred after the ENABLE signal or state was promulgated, such a deceleration would have been detected, chronicled and utilized by the penetrator system 102 in any delayed detonation process it was enacting.

Thus, the present invention enables detection of thin or soft layers only after detection of a deceleration threshold event (such as detecting a minimum layer thickness) but ignores such layers prior to the detection of a deceleration threshold event so as to minimize the potential of missing, misreading or being otherwise confused by any deceleration data produced by a sensor in association with encountering such thin or soft layers.

In the example represented by the graph 180 of FIG. 4, a signal (or a memory state) is produced by the penetrator system 102, as indicated by 194, representative of detection of a void. It is noted that the detection of a void occurs when a relative acceleration occurs in the weapon 100 or penetrator 104 such as is indicated by the voltage returning towards zero on the graph 180. The signal indicated by 194 may simply be a state within a memory component of the penetrator system 102 indicating the state of the void count, or it may be a signal produced to actuate the detonating equipment 154. If detection of a void is simply stored in a memory component (perhaps associated with the computer 150), the penetrator system continues to detect deceleration events until a desired number or layers or voids have been detected. If detection of the void results in a signal being produced) to actuate the detonating equipment 154 (because, for example, the detected void is the intended target of the weapon 100, such detonating equipment 154 then detonates the weapon 100 as discussed hereinabove. It is noted that such detonation may be delayed by a specified period of time to allow the weapon to more fully enter the targeted location and, therefore, inflict a maximum amount of damage to the intended target.

It is noted that various deceleration thresholds or media thresholds may be defined or used in conjunction with the present invention. For example, a minimum media thickness threshold may be defined to include a magnitude of a foot or less or it may be defined to include several feet. Likewise, a minimum deceleration event might include detection of a deceleration of 200 g's (the force of gravity multiplied by 200) over a period of, for example, a millisecond or longer. Such a deceleration event would enable the invention to ignore thin layers such as the ceilings and floors of a building. Of course, other thresholds may be defined depending on various parameters such as the configuration of the weapon and the expected configuration of the sheltered target.

While the invention may be susceptible to various modifications and alternative forms, specific embodiments have been shown by way of example in the drawings and have been described in detail herein. For example, the present invention may include weapons having single or multiple warheads; the present invention may be used in reconnaissance equipment or other nonexplosive equipment; or the penetrator system may be configured to require multiple and varied events prior to detonation or otherwise activate the lethality of the weapon. Thus, it should be understood that the invention is not intended to be limited to the particular forms disclosed and the invention includes all modifications, equivalents, and alternatives falling within the spirit and scope of the invention as defined by the following appended claims.

What is claimed is:

1. A method of detonating a weapon within a shelter, the method comprising:

projecting the weapon through at least one layer of a shelter;

detecting a minimum specified deceleration threshold; including detecting a minimum specified thickness of a layer of the at least one layer through which the weapon is projected;

enabling a delayed detonation program in response to detecting the minimum specified deceleration threshold;

executing the delayed detonation program; and detonating the weapon in accordance with the delayed detonation program.

2. The method according to claim 1, wherein detecting a minimum specified deceleration threshold further includes detecting a minimum specified magnitude of deceleration of the weapon.

3. The method according to claim 2, wherein detecting a minimum specified deceleration threshold further includes detecting the minimum specified magnitude of deceleration of the weapon for a specified minimum duration of time.

4. The method according to claim 1, further comprising ignoring any deceleration events occurring prior to detecting the minimum specified deceleration threshold.

5. The method according to claim 1, wherein projecting the weapon through at least one layer of shelter includes projecting the weapon through a plurality of layers, and wherein the method further comprises ignoring a deceleration event associated with the weapon penetrating at least one of the plurality of layers prior to detecting the minimum specified deceleration threshold.

6. The method according to claim 5, further comprising ignoring a deceleration event associated with the weapon penetrating at least one other of the plurality of layers subsequent to detecting the minimum specified deceleration threshold.

7. The method according to claim 1, further comprising determining a velocity of the weapon.

8. The method according to claim 7, wherein determining a velocity of the weapon further comprises determining a velocity of the weapon prior to detecting a minimum specified deceleration threshold and updating the determined velocity in association with detecting a minimum specified deceleration threshold.

9. The method according to claim 7, further comprising updating the determined velocity in association with detecting at least one deceleration event.

10. The method according to claim 9, wherein determining if the deceleration associated with the penetration of the at least a first layer meets a specified threshold further includes detecting a minimum specified magnitude of deceleration of the weapon.

11. The method according to claim 10, wherein determining if the deceleration associated with the penetration of the at least a first layer meets a specified threshold further includes detecting the minimum specified magnitude of deceleration of the weapon for a specified minimum duration of time.

12. A method of detonating a weapon within a shelter, the method comprising:

projecting the weapon through at least one layer of a shelter;

detecting a minimum specified deceleration threshold;

enabling a delayed detonation program in response to detecting a minimum specified deceleration threshold, wherein executing the delayed detonation program further includes at least one of counting layers of media and counting voids between layers of media encountered by the weapon subsequent to detecting a minimum specified deceleration threshold; and detonating the weapon in accordance with the delayed detonation program.

13. The method according to claim 12, wherein executing the delayed detonation program further includes both counting layers of media and counting voids between the layers of media encountered by the weapon subsequent to detecting a minimum specified deceleration threshold.

14. The method according to claim 12, wherein detecting a minimum specified deceleration threshold further includes detecting a minimum specified magnitude of deceleration of the weapon.

15. The method according to claim 14, wherein detecting a minimum specified deceleration threshold further includes detecting the minimum specified magnitude of deceleration of the weapon for a specified minimum duration of time.

16. The method according to claim 12, further comprising ignoring any deceleration events occurring prior to detecting the minimum specified deceleration threshold.

17. The method according to claim 12, wherein projecting the weapon through at least one layer of shelter includes projecting the weapon through a plurality of layers, and wherein the method further comprises ignoring a deceleration event associated with the weapon penetrating at least one of the plurality of layers prior to detecting the minimum specified deceleration threshold.

18. The method according to claim 17, further comprising ignoring a deceleration event associated with the weapon penetrating at least one other of the plurality of layers subsequent to detecting the minimum specified deceleration threshold.

19. The method according to claim 12, further comprising determining a velocity of the weapon.

20. The method according to claim 19, wherein determining a velocity of the weapon further comprises determining a velocity of the weapon prior to detecting a minimum specified deceleration threshold and updating the determined velocity in association with detecting a minimum specified deceleration threshold.

21. The method according to claim 19, further comprising updating the determined velocity in association with detecting at least one deceleration event.

22. A method of operating a weapon, the method comprising:

launching the weapon at a sheltered target;

penetrating at least a first layer of the sheltered target with the weapon and detecting a deceleration of the weapon associated therewith;

determining if the deceleration associated with the penetration of the at least a first layer meets a specified threshold;

ignoring the deceleration associated with the penetration of the at least a first layer if it does not meet the specified threshold;

enabling a delayed detonation program of the weapon if the deceleration associated with the penetration of the at least a first layer meets the specified threshold;

penetrating an additional layer of the sheltered target subsequent an enablement of the delayed detonation program; and chronicling a deceleration imposed by the additional layer of the sheltered target regardless of whether it meets the specified threshold.

23. The method according to claim 22, further comprising executing the delayed detonation program.

24. The method according to claim 23, wherein executing the delayed detonation program further includes counting subsequent layers of media encountered by the weapon.

25. The method according to claim 24, wherein executing the delayed detonation program further includes counting voids between the subsequent layers of media encountered by the weapon.

26. The method according to claim 22, wherein executing the delayed detonation program further includes counting voids between layers of media subsequently encountered by the weapon.

27. The method according to claim 22, further comprising ignoring a deceleration event subsequent to enabling a delayed detonation program.

28. The method according to claim 22, further comprising determining a velocity of the weapon.

29. The method according to claim 28, further comprising updating the determined velocity in association with detecting at least one deceleration event.

30. A weapon system comprising:

an explosive device having a penetrator structure;

at least one sensor configured to detect deceleration of the weapon system upon impact with a media layer and to produce a signal representative of the deceleration of at least a portion of the weapon system;

a computer in electrical communication with the at least one sensor and configured to ignore detection of all deceleration events by the at least one sensor prior to detection of a minimum specified deceleration threshold that includes detection of a minimum specified thickness of a media layer through which the weapon system is projected.

31. The weapon system of claim 30, wherein the at least one sensor includes at least one of a capacitive accelerometer, a resistive accelerometer, and a micro electromechanical (MEM) accelerometer.

32. The weapon system of claim 31, further comprising at least one filter configured to receive the signal representative of the deceleration of the weapon system.

33. The weapon system of claim 32, wherein the at least one filter includes an anti-aliasing filter.

34. The weapon system of claim 31, further comprising an analog-to-digital converter disposed between and in electrical communication with the at least one sensor and the computer.

35. The weapon system of claim 30, further comprising a detonating mechanism in electrical communication with the computer and configured to detonate the explosive device.

36. The weapon system of claim 30, wherein the computer is further configured to acknowledge all deceleration events detected by the at least one sensor subsequent detection of the minimum specified deceleration threshold.

37. The weapon system of claim 30, wherein the computer is further configured to execute a delayed detonation program subsequent detection of the minimum specified deceleration threshold.

* * * * *